US008464810B2

(12) United States Patent
Haverinen

(10) Patent No.: US 8,464,810 B2
(45) Date of Patent: Jun. 18, 2013

(54) METHOD OF MODIFYING DRILLING PATTERN, ROCK DRILLING RIG, AND SOFTWARE PRODUCT

(75) Inventor: Eemeli Haverinen, Tampere (FI)

(73) Assignee: Sandvik Mining & Construction Oy, Tampere (FI)

( * ) Notice: Subject to any disclaimer, the term of this patent is extended or adjusted under 35 U.S.C. 154(b) by 460 days.

(21) Appl. No.: 12/596,302

(22) PCT Filed: Apr. 15, 2008

(86) PCT No.: PCT/FI2008/050188

§ 371 (c)(1), (2), (4) Date: Oct. 16, 2009

(87) PCT Pub. No.: WO2008/125735

PCT Pub. Date: Oct. 23, 2008

(65) Prior Publication Data

US 2010/0126769 A1 May 27, 2010

(30) Foreign Application Priority Data

Apr. 17, 2007 (FI) ..... 20075262

(51) Int. Cl.
*E21B 7/28* (2006.01)

(52) U.S. Cl.
USPC ..... 175/57; 175/263; 173/1; 173/4

(58) Field of Classification Search
USPC ..... 175/24, 263, 319, 40, 27; 173/1, 173/91, 104, 112, 4, 11, 15; 703/1
See application file for complete search history.

(56) References Cited

U.S. PATENT DOCUMENTS

| | | | | |
|---|---|---|---|---|
| 4,113,033 | A * | 9/1978 | Lindblad | 173/1 |
| 4,240,511 | A | 12/1980 | Mashimo | |
| 4,639,868 | A | 1/1987 | Tanaka et al. | |
| 6,293,355 | B1 * | 9/2001 | Koivunen et al. | 175/26 |
| 6,957,707 | B2 * | 10/2005 | Koivunen et al. | 175/27 |
| 2008/0230270 | A1 * | 9/2008 | Eilo et al. | 175/26 |

FOREIGN PATENT DOCUMENTS

| | | |
|---|---|---|
| JP | 2005220627 | 8/2005 |
| WO | 03/025341 | 3/2003 |
| WO | WO 2007000488 A1 * | 1/2007 |

* cited by examiner

*Primary Examiner* — William P Neuder
*Assistant Examiner* — Ronald Runyan
(74) *Attorney, Agent, or Firm* — Morgan, Lewis & Bockius LLP

(57) ABSTRACT

A method and a storage device including a software product for modifying a drilling pattern, and a rock drilling rig. One or more holes whose location is to be changed may be selected from a drilling pattern prior to drilling. The hole is assigned a new location by means of a drilling unit and, subsequently, the drilling pattern is updated.

10 Claims, 3 Drawing Sheets

METHOD OF MODIFYING DRILLING PATTERN, ROCK DRILLING RIG, AND SOFTWARE PRODUCT

CROSS REFERENCE TO RELATED APPLICATIONS

This application is the National Stage of International Application No. PCT/FI2008/050188, filed Apr. 15, 2008, and claims benefit of Finnish Application No. 20075262, filed. Apr. 17, 2007.

BACKGROUND OF THE INVENTION

The invention relates to a method of modifying a drilling pattern. In the method, an operator modifies a drilling pattern downloaded into a control unit of a rock drilling rig prior to its execution. The invention further relates to a rock drilling rig having a modifiable drilling pattern downloaded into its control unit. The invention still further relates to a software product implementing the method. The subject matter of the invention is defined more specifically in the preambles of the independent claims.

Usually, rock is excavated according to a predetermined plan. In order for the rock to break down in a desired manner upon blasting, holes are drilled for each round according to a predesigned drilling pattern. Typically, such a drilling pattern determines at least start points and drilling directions of the holes to be drilled. It may additionally determine other drilling-related information, such as drilling depth and hole diameter. Designing drilling patterns is office work carried out outside the drilling site, so the designer of a drilling pattern does not have exactly accurate information on the conditions of the particular drilling site. In addition, drilling patterns are designed in advance, which means that errors possibly occurring during blasting cannot be taken into account while designing the drilling patterns. Consequently, it must be possible to be able to modify the drilling pattern even at the drilling site. It is known that the operator modifies the drilling pattern on a display device of the control unit of the rock drilling rig by using a keyboard, mouse or another pointing device of the user interface of the display unit. However, at least when carrying out more complex modifications, a problem is that it is possible, by accident, to make modifications by the display device that in practice are difficult or even impossible to implement. This is at least partially due to the fact that the display device shows the situation as a two-dimensional pattern, while drilling is a three-dimensional operation.

BRIEF DESCRIPTION OF THE INVENTION

An object of the invention is to provide a novel and improved method and software product for modifying a drilling pattern at a drilling site, and a rock drilling rig which enables a novel and improved way of modifying a drilling pattern at a drilling site.

The method according to the invention is characterized by selecting at least one hole in the drilling pattern and connecting location of the start point of the selected hole with the location of the drilling unit; moving the drilling unit manually to a desired location at a drilling site; and modifying the drilling pattern by relocating the start point of the selected hole from an original location to a new location indicated by the drilling unit.

The rock drilling rig according to the invention is characterized in that the control unit enables a software product to be downloaded therein whose execution is configured to produce the following procedures: selecting, indicated by the operator, at least one hole in the drilling pattern and connecting location of the start point of the selected hole with the location of the drilling unit; modifying, in the drilling pattern, the start point of the selected hole from an original location to a new location in response to the drilling unit being moved manually; and updating the drilling pattern by the modifications made.

The software product according to the invention is characterized in that execution of the software product is configured to produce the following procedures: selecting, indicated by the operator, at least one hole in the drilling pattern and connecting location of the start point of the selected hole with the location of the drilling unit; modifying, in the drilling pattern, the start point of the selected hole from an original location to a new location in response to the drilling unit being moved manually; and updating the drilling pattern by the modifications made.

An idea underlying the invention is that a drilling unit is used in modification of a drilling pattern. First, one or more holes whose start point locations an operator, for one reason or another, wishes to change are selected from the drilling pattern. In a control unit, the location of the holes to be relocated is connected with the actual location of the drilling unit. The operator manually controls the drilling unit to move to a desired location at a drilling site and, subsequently, the control unit assigns the holes to be relocated a new, updated location indicated by the drilling unit.

An advantage of the invention is that the operator, in a convenient and illustrative manner, is able to modify the drilling pattern at the drilling site. Since the hole locations are relocated by means of the drilling unit, it becomes automatically ensured that it is also in practice possible to drill the relocated holes. Further, the operator can make good use of all the space allowed by the drilling site. In addition, the operator can see the paths of a drilling boom and positions enabled by the articulations of the boom, as well as knows how to take into account the necessary space also when several drilling units are simultaneously used for drilling. In addition, an advantage of such illustrativeness is the speed of modifications achieved.

An idea underlying an embodiment is that a hole to be relocated is selected on a display device of the control unit by means of a pointing device. The pointing device may be e.g. a joystick, mouse, keyboard, touch screen or the like which enables one or more of the holes in the drilling pattern to be selected for modification. Further, it is possible that the manual control devices of the drilling unit may be connected to temporarily control the pointing device of the display unit. Selecting the hole by means of the display device is quick and illustrative.

An idea underlying an embodiment is that a hole to be relocated is selected by providing the control unit with an ID tag or the like of the hole.

An idea underlying an embodiment is that the location of a selected hole is relocated simultaneously with moving the drilling unit.

An idea underlying an embodiment is that the location of a selected hole is relocated only after the drilling unit has been moved to a desired location and the operator has accepted the relocation.

An idea underlying an embodiment is that both the original location of a hole to be relocated and the new location are displayed on the display unit of the control unit. This makes it easy for the operator to compare the change with the original situation, so he or she is able to assess the magnitude and influence of the change.

An idea underlying an embodiment is that a plurality of holes in the drilling pattern that constitute a group of holes is selected for relocation. The start points of all holes belonging to the group of holes are relocated simultaneously to a new location indicated by the drilling unit. The mutual position of the start points of the holes with respect to one another is, however, kept unchanged during the relocation. Of course, after the relocation the operator may modify the mutual location of the holes in the group of holes as well. This embodiment enables the operator to modify the drilling pattern quickly and easily. The operator may choose a desired part of the drilling pattern, e.g. a cut and the related holes and, subsequently, he or she may assign a new location to the cut.

An idea underlying an embodiment is that the drilling direction of a hole to be relocated is kept unchanged. In such a case, modification to be carried out by the drilling unit simply involves the location of the start point of the hole only. Thus, after the relocation, the hole has its original direction. However, if desired, the direction of the hole may be modified later, e.g. by entering a new drilling direction via the user interface of the control unit.

An idea underlying an embodiment is that the drilling unit is placed in a desired drilling direction at a location to which it has been moved manually. Further, the drilling direction of one or more holes to be relocated is changed to conform with the drilling direction of the drilling unit. Hence, this embodiment utilizes the location and direction of the drilling unit in modification of the drilling pattern. The operator can see the drilling site and is capable of placing the drilling unit in a suitable drilling direction.

An idea underlying an embodiment is that the control unit is configured to suggest a new direction for a relocated hole. The control unit may suggest a direction by the use of which an end point of the relocated hole may be brought to approximately correspond with the one at the original location, or it may suggest a direction according to another criterion. The operator may accept or reject the direction suggested by the control unit. The embodiment may make the drilling pattern quicker to modify.

An idea underlying an embodiment is that a hole location is displayed on the display device of the control unit by means of a first symbol. Further, a plurality of holes to be relocated simultaneously is selected to constitute a group of holes and one common gripping area is determined for the group of holes to be relocated, the location of the gripping area being displayed on the display device by means of a second symbol. Next, the drilling pattern is modified by manually moving the drilling unit, whereby the location of the first symbol becomes updated on the display device. The second symbol of the group of holes to be relocated moves either simultaneously with the first symbol or only just after the operator has accepted the relocation. After the group of holes has been modified, the situation is eventually displayed on the display device such that the first symbol and the second symbol are provided on top of one another.

An idea underlying an embodiment is that in order to modify a drilling pattern, a software product is downloaded into a control unit of a rock drilling rig from a storage or memory means, such as a memory stick, memory disc, hard disc, information network server or the like, execution of the software product in the control unit producing procedures described in the present application.

An idea underlying an embodiment is that one or more holes in the drilling pattern are relocated to a new location at which they are assigned at least new start point coordinates as well as one or more of the following: new end point coordinates, new hole direction angle, new hole length.

An idea underlying an embodiment is that one or more holes in the drilling pattern are relocated to a new location indicated by a drilling unit and, subsequently, the drilling pattern is updated both as far as the relocated hole is concerned and taking into account the necessary changes caused by the relocated hole to holes that are not relocated in that particular manner. A software product used for modifying the drilling pattern may change the parameters of the holes surrounding the relocated hole, or even the parameters of all other holes, on the basis of the relocation carried out.

BRIEF DESCRIPTION OF THE FIGURES

Some embodiments of the invention are described in closer detail in the accompanying drawings, in which.

For the sake of clarity, the figures show some embodiments of the invention in a simplified manner. In the figures, like reference numerals identify like elements.

DETAILED DESCRIPTION OF SOME EMBODIMENTS OF THE INVENTION

Figure 1:
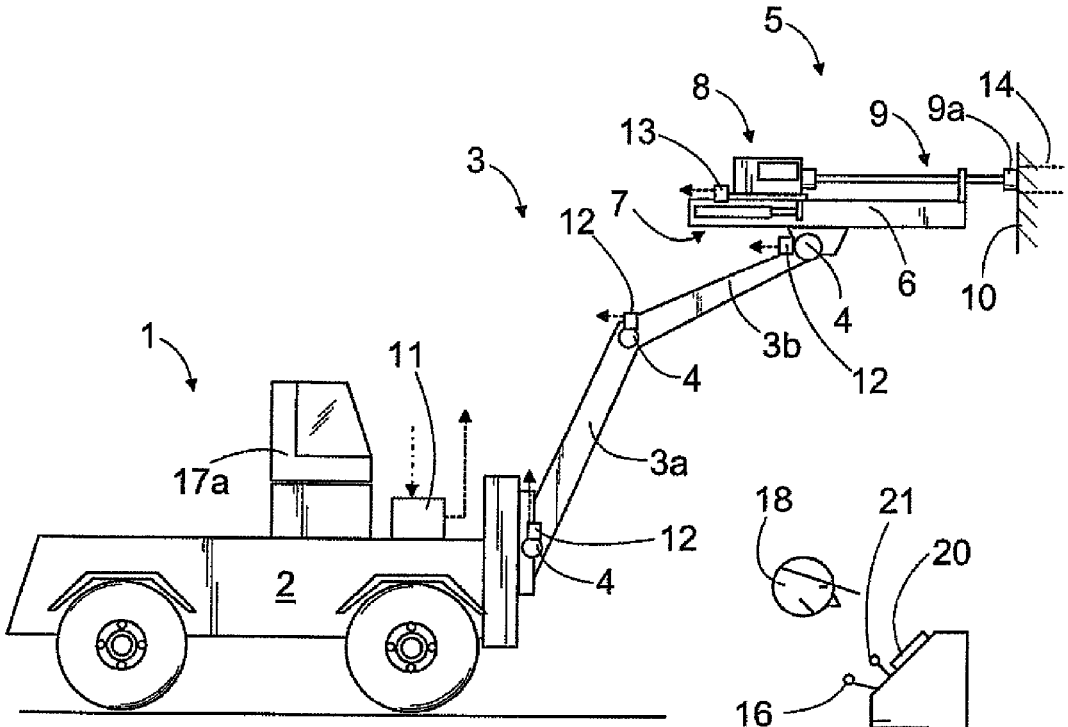
FIG. 1 is a schematic side view showing a rock drilling rig, FIG. 2 schematically shows control means of a rock drilling rig, FIG. 3 schematically shows a drilling pattern as seen in direction xz, FIG. 4 schematically and on a display device of a control unit shows some holes in a drilling pattern prior to modification, FIG. 5 schematically and on a display device of a control unit shows the holes according to FIG. 4 after modification, FIG. 6 schematically and in yz projection shows a tunnel face and various drilling situations, and FIG. 7 further schematically shows a user interface for a control unit.
Figure 3:
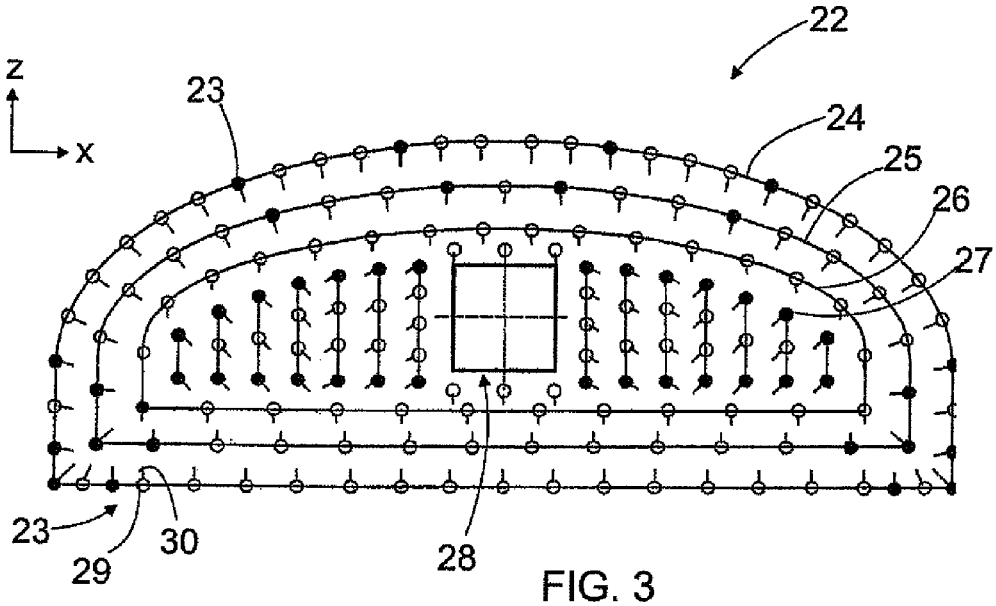

A rock drilling rig 1 shown in FIG. 1 comprises a movable carrier 2 provided with one or more drilling booms 3. The drilling boom 3 may consist of one or more boom parts 3*a*, 3*b* that may be engaged with one another and with the carrier 2 by articulations 4 so that the booms 3 may be moved in a versatile manner in different directions. Further, a free end of each drilling boom 3 may be provided with a drilling unit 5 which may comprise a feed beam 6, a feed device 7, a rock drill machine 8, as well as a tool 9 whose outer end may be provided with a drill bit 9*a*. The rock drill machine 8 may be moved by means of the feed device 7 with respect to the feed beam 6 so as to enable the tool 9 to be fed towards rock 10 during drilling. The rock drill machine 8 may comprise a percussion device for delivering stress pulses on the tool 9, and further, a rotating device for rotating the tool 9 about its longitudinal axis. The rock drilling rig 1 may further comprise one or more control units 11 for controlling the drilling. The control unit 11 may comprise one or more processors, a programmable logic or a similar device for executing a software product whose execution produces a method according to the invention. In addition, the control unit 11 may be provided with a drilling pattern determining at least the location and direction of holes to be drilled. FIG. 3 below shows a drilling pattern 22. The control unit 11 may further be provided with a drilling sequence further determining at least a drilling order of the holes. The control unit 11 may give commands to actuators moving the drilling boom 3, to the feed device 7, as well as to other actuators influencing the location of the drilling unit 5. Furthermore, one or more sensors 12 may be provided in connection with the articulations 4 of the drilling boom 3, and one or more sensors 13 may be provided in connection with the drilling unit 5. Measurement information obtained from the sensors 12, 13 may be communicated to the control unit 11 which, on the basis of the measurement information, may determine the location and direction of the drilling unit 5 for control. The control unit 11 may be configured to process the position of the drilling unit 5 as the location of the drill bit 9*a* and as the direction of the longitudinal axis of the tool 9.

Figure 2:
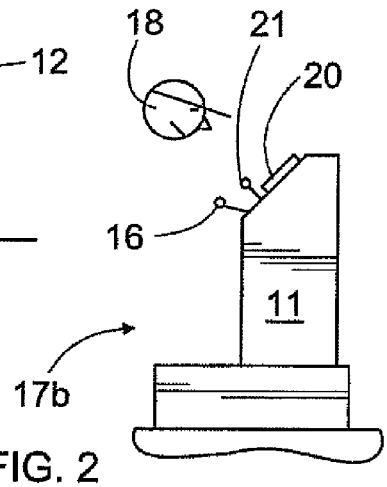

FIG. 2 shows manual control devices 16 provided in a control cabin 17*a* or on a drilling plane 17*b* of the rock drilling rig 1 and enabling an operator 18 to move the drilling unit 5 to a desired location when drilling is controlled manually. A drilling pattern may be displayed to the operator by means of a display device 20 of the control unit 11. Further, the location of the drilling unit 5 may be displayed by the display device 20 on the basis of the measurement information obtained from the sensors 12, 13. A separate pointing device 21, such as a joystick or the like, may further be provided in connection with the display device 20 to enable commands to be given to the control unit 11. The operator 18 may modify a drilling pattern being displayed on the display device 20 by selecting one or more holes by the pointing device 21 and, subsequently, moving the drilling unit 5 to the desired location by means of the manual control device 16, whereby a control strategy provided in the control unit 11 knows how to assign the selected holes a new, updated location on the basis of the location of the drilling unit 5.

FIG. 3 shows a drilling pattern 22 provided with a plurality of hole locations 23 arranged in several rows 24 to 26 that lie one within the other. Furthermore, the drilling pattern may be provided with field holes 27 placed over a portion between the inner hole row 26 and a cut 28. Two or more field holes 27 may constitute a field hole element. Usually, the cut 28 also comprises several holes. In the drilling pattern 22, the location of the hole 23 may be presented as a circle 29. Further, the direction of each hole 23 may be presented in the drilling pattern 22 by a directional line 30. The xz projection shown in FIG. 3, or any other projection, of the drilling pattern 22 may be presented on the display device 20 of the control unit 11.

Figure 4:
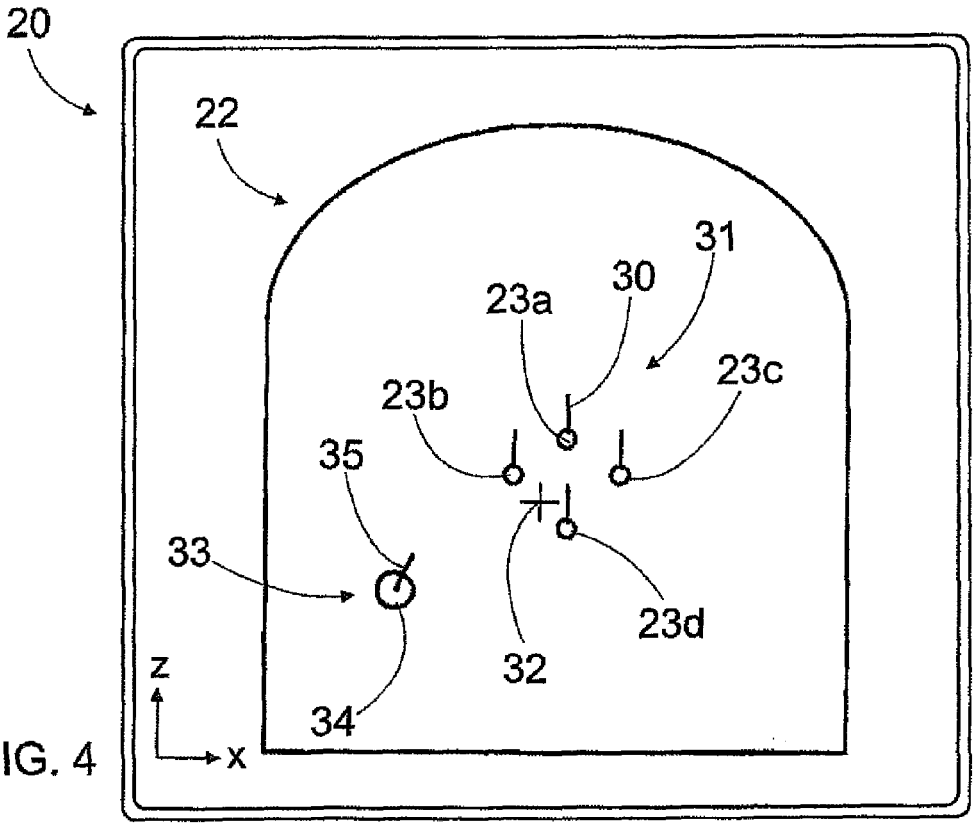

FIG. 4 shows, on the display device 20, a group of holes 31 consisting of four holes 23*a* to 23*d* and selected by the operator for relocation. The holes in the group of holes 31 may be selected e.g. by moving the cursor or a similar pointing device in the display device 20. Alternatively, the operator may give the tags of the holes he or she has selected to the control unit. It is further possible that already while designing a drilling pattern 22, two or more holes 23 are determined to constitute a group of holes 31. The drilling pattern 22 may include different groups of holes 31, such as groups of field holes, a group of cut holes, etc. The selected group of holes 31 and the holes 23*a* to 23*d* therein may be displayed on the display device 20 so as to catch the attention, e.g. by means of colour, different thickness of line or different brightness, to enhance the illustrative effect. Further, the control unit 11 may automatically determine a gripping area 32 for the group of holes 31 or, alternatively, the operator may manually determine the location of the gripping area 32. All the holes 27 in the group of holes 31 are controlled simultaneously by means of the gripping area 32. Further, the actual location of the drilling unit 5 may be shown on the display device 20 by means of a symbol 34, and its direction by means of a directional line 35.

Figure 5:
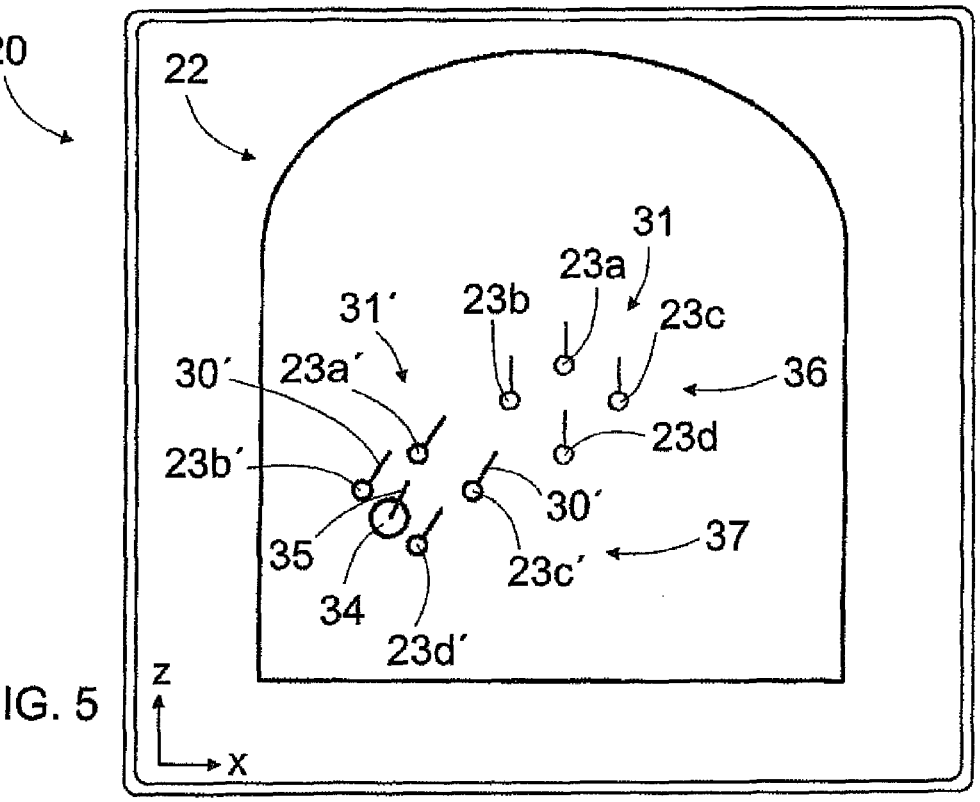

FIG. 5 shows in bolder lines a group of holes 31' which has been relocated from its original location 36 to a new location 37. The figure shows no gripping area 32 since its location matches with that of the symbol 34 designating the drilling unit 5. Further, in addition to the start points of holes 23, drilling directions 30' may also be modified to conform with the direction 35 of the drilling unit 5. After the operator has accepted the relocation and updated the drilling pattern 22, the original holes 23*a* to 23*d* may be deleted from view. If necessary, however, it is also possible to bring them into view later if, for example, the original drilling pattern is to be returned subsequently.

Figure 6:
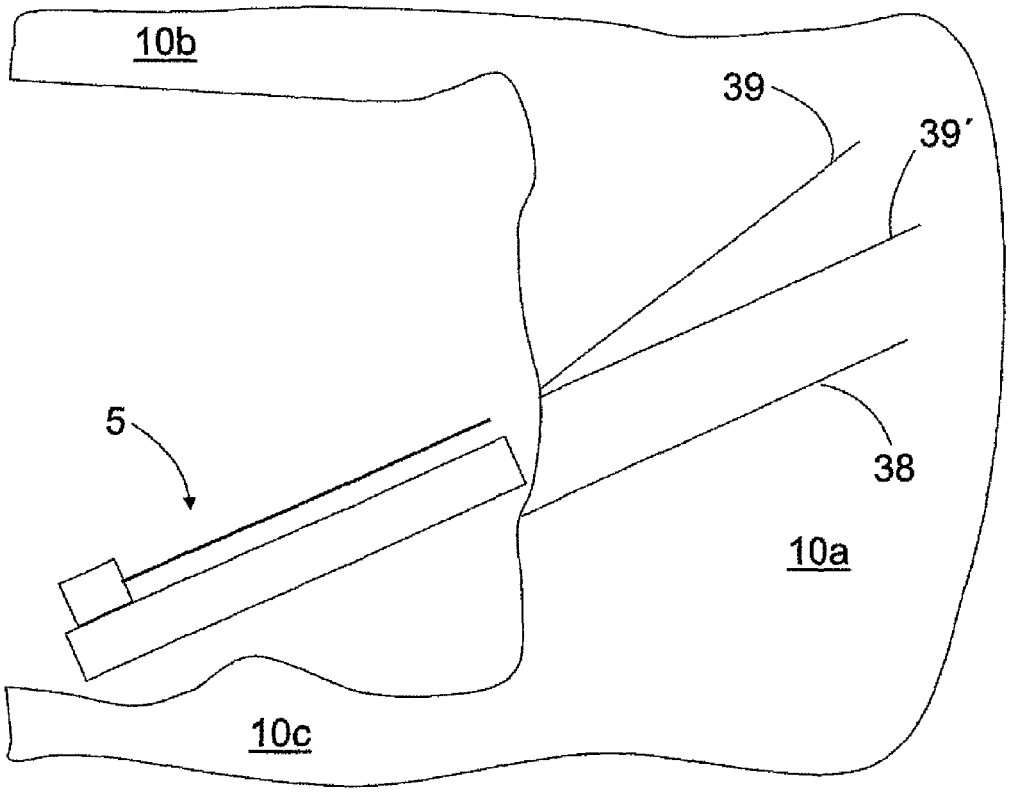

FIG. 6 illustrates a situation at a drilling site, which may be e.g. a tunnel with a tunnel face 10*a*, a ceiling 10*b*, and a floor 10*c*. Holes are drilled into the tunnel face 10*a* or into the ceiling 10*b* for blasting. The surfaces defining the drilling site are not always straight and even, since rock does not always break neatly upon blasting. Consequently, the drilling pattern 22 may have to be modified at the drilling site. For instance, a hole 38 in the original drilling pattern according to FIG. 6 is impossible to drill at all since the uneven floor 10*c* makes it impossible to place the drilling unit 5 in the determined start point and drilling direction. Therefore, the location and direction of the particular hole have to be modified. In the situation shown in FIG. 6, it is also impossible to drill a hole 39 by using the drilling unit 5; therefore, the drilling pattern is modified such that the direction and possibly the location of the hole are modified to be relocated to a point 39', which enables the particular hole to be drilled.

Figure 7:
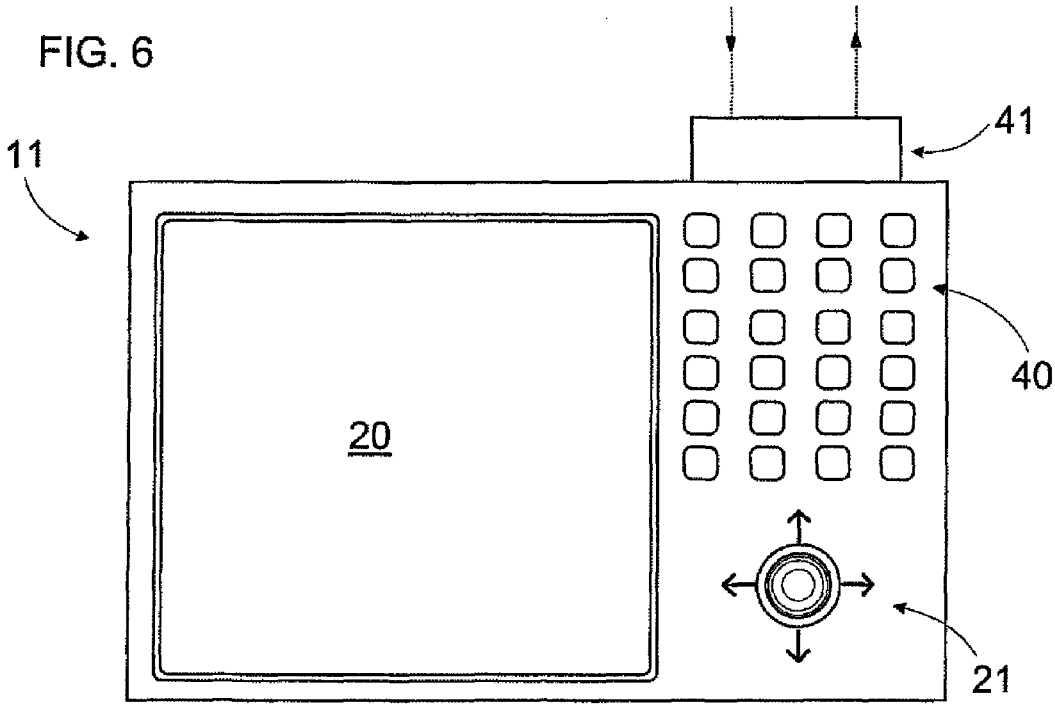

FIG. 7 shows a display device 20 of a control unit 11 of a rock drilling rig, and a user interface thereof. Control commands may be given by means of a keyboard 40 and a pointing device 21. The control unit 11 may be provided with one or more data communication units 41 through which the control unit 11 may be wiredly or wirelessly connected to sensors 12, 13 as well as to actuators belonging to the rock drilling rig 1 for communication of measurement information and control commands. Further, the control unit 11 may be provided with one or more read devices for reading a software product and for providing control parameters. Alternatively, information may be fed to the memory of the control unit 11 by means of the keyboard or a data communication connection. The control unit 11 may be provided with one or more processors or similar electronic devices to enable a software product to be executed for carrying out modification procedures according to the invention. The software product may be read from a memory means or it may be downloaded from another computer or information network. On the other hand, the software product may be a so-called hardware solution.

It is further possible that one or more holes in the drilling pattern are relocated by the operator 18 to a new location indicated by the drilling unit and, subsequently, the control unit 11 updates the drilling pattern both as far as the relocated hole is concerned and taking into account the necessary changes caused by the relocated hole to holes that are not assigned a new location by the drilling unit. The software product to be executed in the control unit 11 of the rock drilling rig and to be used for modifying the drilling pattern may change the parameters of the holes surrounding the relocated hole, or even of all other holes in the drilling pattern, on the basis of the relocation carried out. Alternatively, the holes in the drilling pattern may be updated in some other control unit with which the control unit 11 of the rock drilling rig may communicate via a data communication connection. In such a case if, for instance, the operator 18, owing to fissured rock or rock of otherwise poor quality, suggests a new location for the cut 28, the control unit 11 of the rock drilling rig provides the cut with a new, updated location and, further, the control unit 11 of the rock drilling rig or an external control unit may determine one or more new holes to be located at the original location of the cut as well as change the parameters of the holes near the new location of the cut. The control unit may take notice of the changes made to the drilling pattern and, if necessary, even remodify the entire drilling pattern, taking the relocated hole or group of holes into account. This is to ensure that rock breaks as designed during a round. In order to make the modifications easier, the drilling pattern may further include pre-set algorithms to facilitate the modification in the control unit.

It is to be noted that in addition to excavation of tunnels, underground storage halls and other underground premises, the solution according to the invention may also be applied to other excavation projects requiring rock drilling, such as benching.

In some cases, the features disclosed in the present application may be used as such, irrespective of other features. On the other hand, when necessary, the features disclosed in the present invention may be combined so as to provide different combinations.

The drawings and the related description are only intended to illustrate the idea of the invention. In its details, the invention may vary within the scope of the claims.

The invention claimed is:

1. A method of modifying a drilling pattern in a rock drilling rig, the rock drilling rig comprising: at least one drilling boom; a drilling unit arranged in the drilling boom; at least one sensor for determining a location and a direction of the drilling unit; at least one control unit provided with a user interface and the drilling pattern downloaded therein, the drilling pattern determining at least start points and drilling directions of holes to be drilled; as well as at least one control member for manually controlling the location of the drilling unit, the method comprising:

displaying, on a display device of the control unit, start points of holes according to the drilling pattern, modifying the drilling pattern in the rock drilling rig prior to execution by modifying a start point coordinate and one or more of an end point coordinate, a drilling direction and a hole length, updating the drilling pattern to include the modifications made, selecting a subset of holes in the drilling pattern and connecting a location of a start point of the selected subset of holes with the location of the drilling unit, moving the drilling unit manually to a new location at a drilling site, the new location differing from the locations of the start points defined in the drilling pattern, and modifying the drilling pattern by relocating the start point of the selected subset of holes from an original location to the new location indicated by the drilling unit.

2. A method as claimed in claim 1, comprising selecting the subset of holes to be relocated on the display device of the control unit by means of a pointing device.

3. A method of modifying a drilling pattern in a rock drilling rig, the rock drilling rig comprising: at least one drilling boom; a drilling unit arranged in the drilling boom; at least one sensor for determining a location and a direction of the drilling unit; at least one control unit provided with a user interface and the drilling pattern downloaded therein, the drilling pattern determining at least start points and drilling directions of holes to be drilled; as well as at least one control member for manually controlling the location of the drilling unit, the method comprising:

displaying, on a display device of the control unit, start points of holes according to the drilling pattern, modifying the drilling pattern in the rock drilling rig prior to execution, updating the drilling pattern to include the modifications made, selecting a subset of holes in the drilling pattern and connecting a location of a start point of the selected subset of holes with the location of the drilling unit, moving the drilling unit manually to a new location at a drilling site, the new location differing from the locations of the start points defined in the drilling pattern, modifying the drilling pattern by relocating the start point of the selected subset of holes from an original location to the new location indicated by the drilling unit, and displaying the original location of the subset of holes to be relocated as well as the new location thereof simultaneously on the display device of the control unit.

4. A method of modifying a drilling pattern in a rock drilling rig, the rock drilling rig comprising: at least one drilling boom; a drilling unit arranged in the drilling boom; at least one sensor for determining a location and a direction of the drilling unit; at least one control unit provided with a user interface and the drilling pattern downloaded therein, the drilling pattern determining at least start points and drilling directions of holes to be drilled; as well as at least one control member for manually controlling the location of the drilling unit, the method comprising:

displaying, on a display device of the control unit, start points of holes according to the drilling pattern, modifying the drilling pattern in the rock drilling rig prior to execution, updating the drilling pattern to include the modifications made, selecting a subset of holes in the drilling pattern and connecting a location of a start point of the selected subset of holes with the location of the drilling unit, moving the drilling unit manually to a new location at a drilling site, the new location differing from the locations of the start points defined in the drilling pattern, modifying the drilling pattern by relocating the start point of the selected subset of holes from an original location to the new location indicated by the drilling unit, selecting for relocation, a plurality of holes in the drilling pattern constituting the selected subset of holes, relocating simultaneously start points of all holes belonging to the selected subset of holes to the new location indicated by the drilling unit, and keeping a mutual position of the start points of all holes belonging to the selected subset of holes with respect to one another unchanged during the relocation.

5. A method as claimed in claim 1, comprising keeping the drilling direction of the relocated subset of holes unchanged.

6. A method of modifying a drilling pattern in a rock drilling rig, the rock drilling rig comprising: at least one drilling boom; a drilling unit arranged in the drilling boom; at least one sensor for determining location and direction of the drilling unit; at least one control unit provided with a user interface and the drilling pattern downloaded therein, the drilling pattern determining at least start points and drilling directions of holes to be drilled; as well as at least one control member for manually controlling the location of the drilling unit, the method comprising:

displaying, on a display device of the control unit, start points of holes according to the drilling pattern, modifying the drilling pattern in the rock drilling rig prior to execution, updating the drilling pattern to include the modifications made, selecting a subset of holes in the drilling pattern and connecting a location of a start point of the selected subset of holes with the location of the drilling unit, moving the drilling unit manually to a new location at a drilling site, the new location differing from the locations of the start points defined in the drilling pattern, modifying the drilling pattern by relocating the start point of the selected subset of holes from an original location to the new location indicated by the drilling unit, placing the drilling unit in a desired drilling direction at a location to which it has been moved manually, and changing the drilling direction of the selected subset of holes to conform with the drilling direction of the drilling unit.

7. A method of modifying a drilling pattern in a rock drilling rig, the rock drilling rig comprising: at least one drilling boom; a drilling unit arranged in the drilling boom; at least one sensor for determining a location and a direction of the drilling unit; at least one control unit provided with a user interface and the drilling pattern downloaded therein, the drilling pattern determining at least start points and drilling directions of holes to be drilled; as well as at least one control member for manually controlling the location of the drilling unit, the method comprising:

displaying, on a display device of the control unit, start points of holes according to the drilling pattern, modifying the drilling pattern in the rock drilling rig prior to execution, updating the drilling pattern to include the modifications made, selecting a subset of holes in the drilling pattern and connecting a location of a start point of the selected subset of holes with the location of the drilling unit, moving the drilling unit manually to a new location at a drilling site, the new location differing from the locations of the start points of holes defined in the drilling pattern, modifying the drilling pattern by relocating the start point of the selected subset of holes from an original location to the new location indicated by the drilling unit, displaying, on the display device of the control unit, the location of the drilling unit by means of a first symbol, selecting a plurality of holes to be relocated simultaneously to constitute the subset of holes, determining one common gripping area for the subset of holes to be relocated and displaying its location on the display device by means of a second symbol, and displaying, on the display device, a situation after the relocation of the subset of holes such that the first symbol and the second symbol are provided on top of one another.

8. A method as claimed in claim 1, comprising modifying at least one other hole in the drilling pattern on the basis of the relocated subset of holes.

9. A rock drilling rig, comprising:

a movable carrier, at least one drilling boom and at least one drilling unit which comprises a feed beam arranged in the drilling boom, a rock drill machine movable by means of a feed device with respect to the feed beam, and a tool connectable to the rock drill machine, at least one control unit provided with a drilling pattern determining at least start points and drilling directions of holes to be drilled, a display device of the control unit to enable the drilling pattern to be displayed, at least one control member for manually controlling the drilling unit, and at least one sensor for determining location and direction of the drilling unit, wherein the control unit includes a software product therein whose execution is configured to produce the following procedures:

selecting, indicated by the operator, a subset of holes in the drilling pattern and connecting a location of the start point of the selected subset of holes with a location of the drilling unit, modifying, in the drilling pattern, the start point of the selected subset of holes from an original location to a new location and one or more of an end point coordinate, a drilling direction and a hole length in response to the drilling unit being moved manually, and updating the drilling pattern to include the modifications made.

10. A storage device including a software product for modifying a drilling pattern in a rock drilling rig prior to drilling, the rock drilling rig comprising a movable carrier; at least one drilling boom and at least one drilling unit which comprises a feed beam arranged in the drilling boom, a rock drill machine movable by means of a feed device with respect to the feed beam, and a tool connectable to the rock drill machine; at least one control unit provided with a drilling pattern determining at least start points and drilling directions of holes to be drilled; a display device of the control unit to enable the drilling pattern to be displayed; at least one control member for manually controlling the drilling unit; at least one sensor for determining a location and a direction of the drilling unit, wherein execution of the software product is configured to produce the following procedures:

selecting, indicated by the operator, a subset of holes in the drilling pattern and connecting a location of a start point of the selected subset of holes with the location of the drilling unit, modifying, in the drilling pattern, the start point of the selected subset of holes from an original location to a new location and one or more of an end point coordinate, a drilling direction and a hole length in response to the drilling unit being moved manually, and updating the drilling pattern to include the modifications made.

* * * * *